US012193558B1

(12) United States Patent
Lin

(10) Patent No.: US 12,193,558 B1
(45) Date of Patent: Jan. 14, 2025

(54) ENVIRONMENTALLY FRIENDLY COSMETIC CONTAINER

(71) Applicant: LIBO COSMETICS CO., LTD., Taichung (TW)

(72) Inventor: Hsiao-Yun Lin, Taichung (TW)

( * ) Notice: Subject to any disclaimer, the term of this patent is extended or adjusted under 35 U.S.C. 154(b) by 0 days.

(21) Appl. No.: 18/486,174

(22) Filed: Oct. 13, 2023

(51) Int. Cl.

| | |
|---|---|
| ***A45D 40/06*** | (2006.01) |
| ***A45D 40/02*** | (2006.01) |
| ***A45D 40/04*** | (2006.01) |
| ***A45D 40/12*** | (2006.01) |
| *A45D 40/00* | (2006.01) |

(52) U.S. Cl.
CPC ..... *A45D 40/04* (2013.01); *A45D 40/02* (2013.01); *A45D 40/023* (2013.01); *A45D 40/06* (2013.01); *A45D 40/065* (2013.01); *A45D 40/12* (2013.01); *A45D 2040/0025* (2013.01)

(58) Field of Classification Search
CPC ..... A45D 40/02; A45D 40/023; A45D 40/06; A45D 40/065; A45D 40/12; A45D 2040/0025
See application file for complete search history.

(56) References Cited

U.S. PATENT DOCUMENTS

| | | | | |
|---|---|---|---|---|
| 3,586,452 A * | 6/1971 | Mason | ..... | A45D 40/06 401/78 |
| 11,633,031 B2 * | 4/2023 | Lin | ..... | A45D 40/02 206/385 |

* cited by examiner

*Primary Examiner* — Jennifer C Chiang
(74) *Attorney, Agent, or Firm* — Bruce Stone LLP; Joseph A. Bruce

(57) ABSTRACT

A cosmetic container includes a cup, a cylinder, a lining, a sleeve and a collar. The cup includes a boss. The cylinder includes a rectilinear slot in a first section to receive the boss when the cylinder receives the cup, a slit and a recess in a second section. The lining includes a helical slot for receiving the boss when the lining receives the first section of the cylinder. The collar includes an internal ridge and an internal protuberance. The internal ridge is movable along the slit when the second section of the cylinder is inserted in the collar. The internal protuberance is inserted in the recess.

3 Claims, 8 Drawing Sheets

ENVIRONMENTALLY FRIENDLY COSMETIC CONTAINER

BACKGROUND OF INVENTION

1. Field of Invention

The present invention relates to a cosmetic container and, more particularly, to an environmentally friendly cosmetic container.

2. Related Prior Art

A conventional container for a lipstick includes a cap and a handle assembly. The handle assembly includes a handle, a cylinder, and a guiding module. The cylinder includes a first section formed with a rectilinear slot and a second section fitted in the handle. The guiding module includes a sleeve and a lining. The lining includes a helical slot. The lining is inserted in the sleeve. The second section of the cylinder is inserted in the sleeve so that they are rotatable relative to each other. A section of the rectilinear slot is in communication with a section of the helical slot of the lining. A lower section of a lipstick is inserted in a cup that includes a boss extending from an external face. The cup is inserted in the second section of the cylinder. The boss is movably inserted in the helical slot and the rectilinear slot. Thus, the cup is translatable along but not rotatable relative to the cylinder. Moreover, the cup is translated relative to the lining when the cup and the cylinder are rotated relative to the lining. Accordingly, an upper section of the lipstick is extended from or into the guiding module. The cooperation of the guiding module with the cup enables extension of the lipstick into or from the cylinder. The lining is made of a plastic material such as polyethylene terephthalate ("PET" or "PETE") for easy making of the helical slot, and the sleeve is made of metal for adequate strength. Adhesive is provided between the sleeve and the lining to keep the lining in the sleeve. However, the use of the adhesive renders it extremely difficult, if not impossible, to detach the sleeve from the lining. Hence, it is it extremely difficult if not impossible to recycle the sleeve and the lining separately. This is bad for the protection of the environment.

Therefore, the present invention is intended to obviate or at least alleviate the problems encountered in the prior art.

SUMMARY OF INVENTION

It is the primary objective of the present invention to provide an environmentally friendly cosmetic container.

To achieve the foregoing objective, the cosmetic container includes a cup, a cylinder, a lining, a sleeve and a collar. The cup includes a boss. The cylinder includes a rectilinear slot in a first section to receive the boss when the cylinder receives the cup, a slit and a recess in a second section. The lining includes a helical slot for receiving the boss when the lining receives the first section of the cylinder. The collar includes an internal ridge and an internal protuberance. The internal ridge is movable along the slit when the second section of the cylinder is inserted in the collar. The internal protuberance is inserted in the recess.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
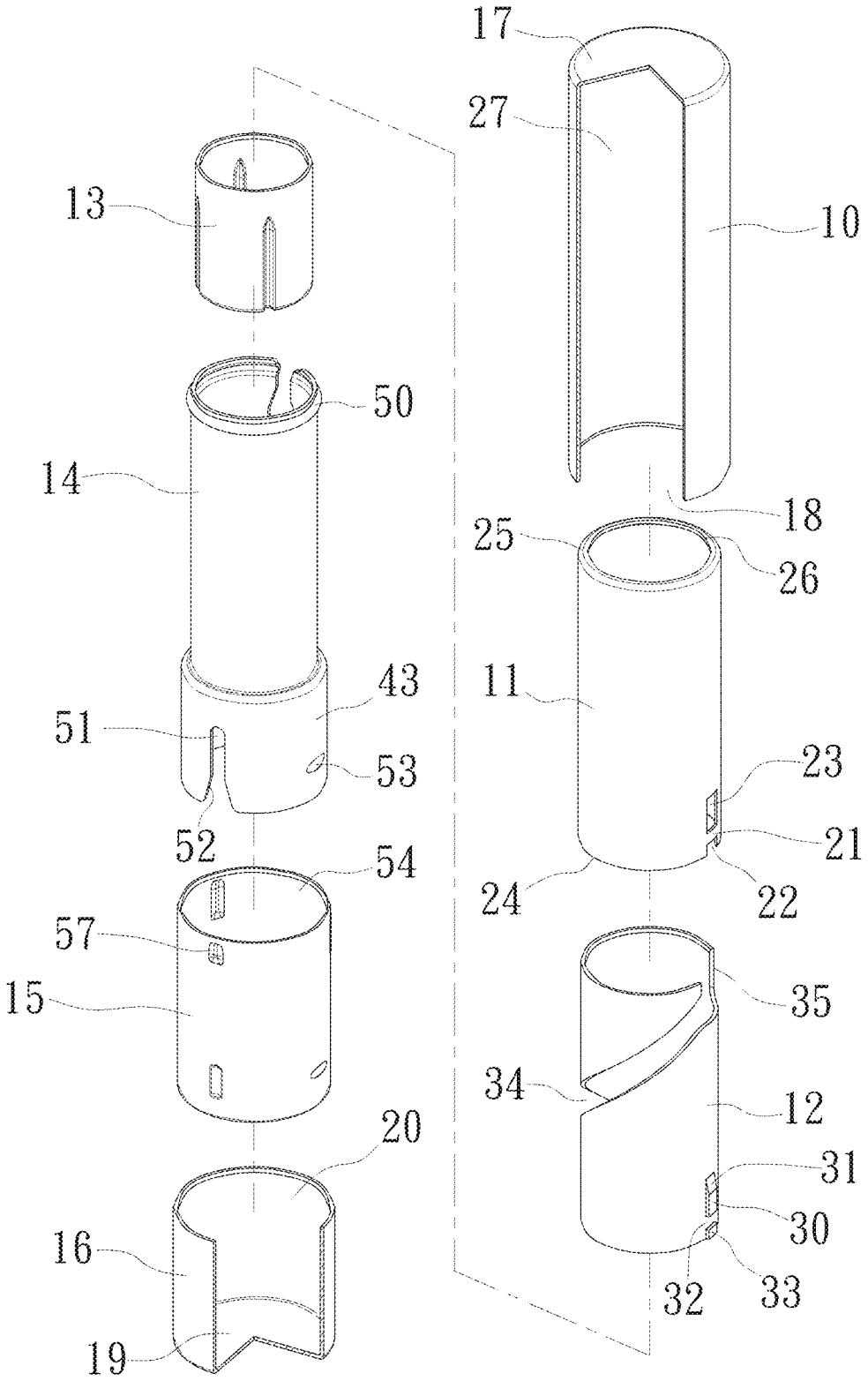
FIG. 1 is an exploded view of a cosmetic container according to the preferred embodiment of the present invention.

Referring to FIG. 1, a cosmetic container includes a cap 10, a sleeve 11, a lining 12, a cup 13, a cylinder 14, a collar 15 and a grip 16 according to the preferred embodiment of the present invention. The cap 10 includes a closed end 17 and an open end 18.

The sleeve 11 include two open ends 24 and 26. The sleeve 11 further includes an inward flange 25 extending around the open end 26 so that the open end 26 is smaller than the open end 24. The sleeve 11 further includes a cutout 22 in a lower edge and an aperture 23 in a lower section. The cutout 22 is located properly below the aperture 23. The aperture 23 is separated from the cutout 22 by a miniature bar 21.

Figure 2:
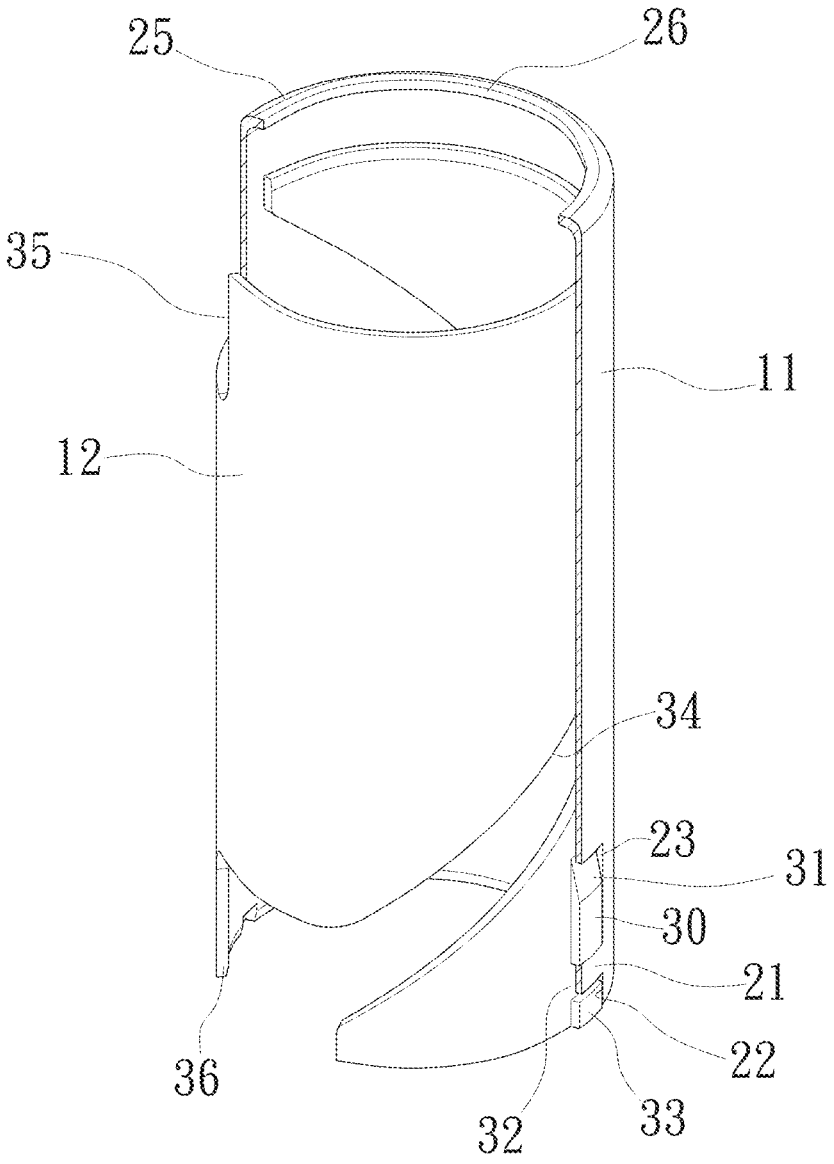
FIG. 2 is a perspective view of a lining and a sleeve of the cosmetic container shown in FIG. 1.

The lining 12 includes a guiding block 30, a stopping block 33 and a helical slot 34. The guiding block 30 and the stopping block 33 are formed on an external face of the lining 12. The stopping block 33 is located at a lower end of the lining 12. The guiding block 30 is located above the stopping block 33. The guiding block 30 is separated from the stopping block 33 by a gap 32. The width (or "breadth") of the gap 32 is larger than the width (or "breadth") of the miniature bar 21. The guiding block 30 is formed with a slope 31 at an upper (or "leading") end. The helical slot 34 includes two ends 35 and 36 (FIG. 2).

Figure 3:
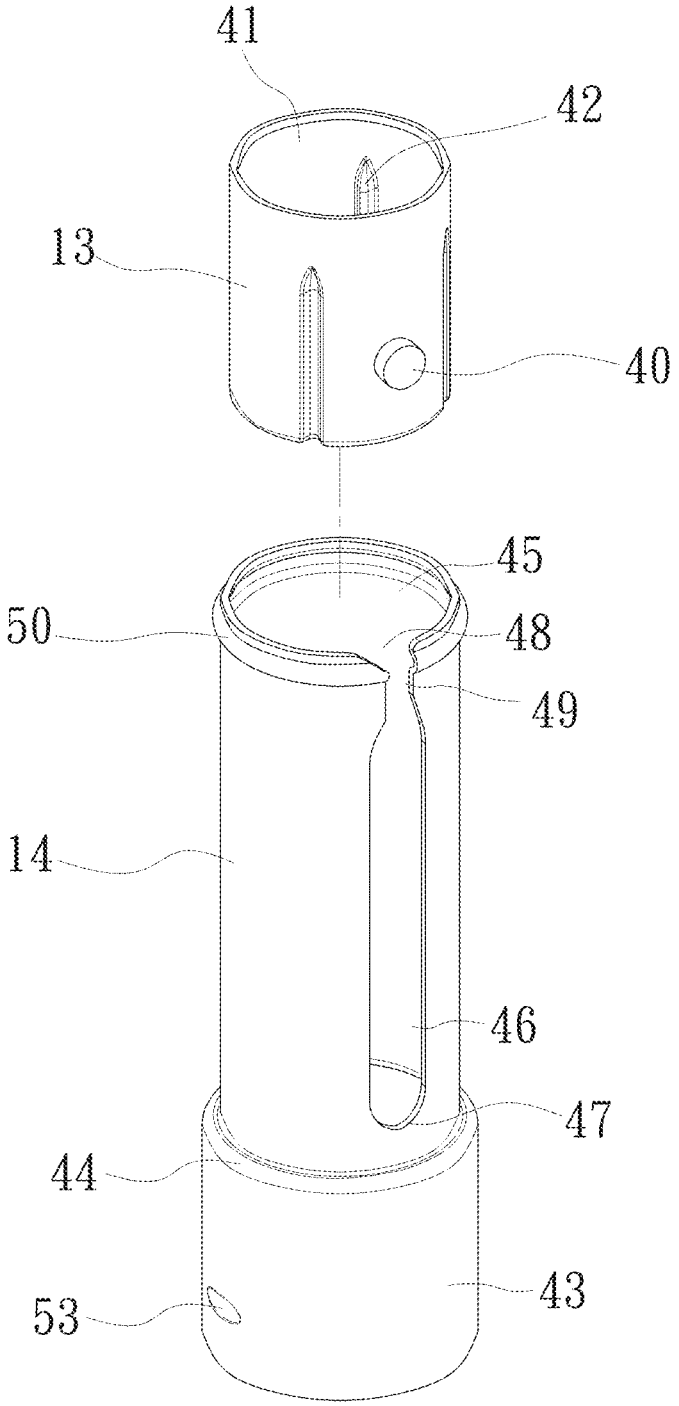
FIG. 3 is a perspective view of a cup and a cylinder of the cosmetic container shown in FIG. 1.

The cylinder 14 includes a space 45 in communication with a rectilinear slot 46 (FIG. 3), an annular ridge 50 formed around an upper end, an enlarged section 43 formed at a lower end, and a shoulder 44 formed next to the enlarged section 43. The rectilinear slot 46 includes a closed end 47 adjacent to the enlarged section of the cylinder 14, an open end 48 at the upper end of the cylinder 14, and a reduced section 49 adjacent to the open end 48. The enlarged section 43 of the cylinder 14 includes a slit 51 and a recess 53. The slit 51 includes a funnel-like open end 52 at the lower end of the cylinder 14. The recess 53 is made in an external face of the enlarged section 43 of the cylinder 14.

The cup 13 includes a boss 40, a space 41 and ridges 42. The boss 40 extends from an external face of the cup 13 in a radial direction. The ridges 42 extend from an internal face of the cup 13 in a longitudinal direction.

Referring to FIGS. 3 and 5 through 8, the collar 15 includes a space 54, an inward flange 55, external protuberances 57, an internal ridge 59 and internal protuberances 60. The external protuberances 57 are preferably made by punching an internal face of the collar 15, which is made of a metal plate. The internal ridge 59 and the internal protuberances 60 are made by punching an external face of the collar 15. The inward flange 55 extends around an axis of the collar 15. The external protuberances 57 are evenly located around the axis of the collar 15, and so are the internal protuberances 60.

The grip 16 includes a closed end 19, an open end (not numbered) located opposite to the closed end 19, and a space 20 between the closed end 19 and the open end.

Figure 4:
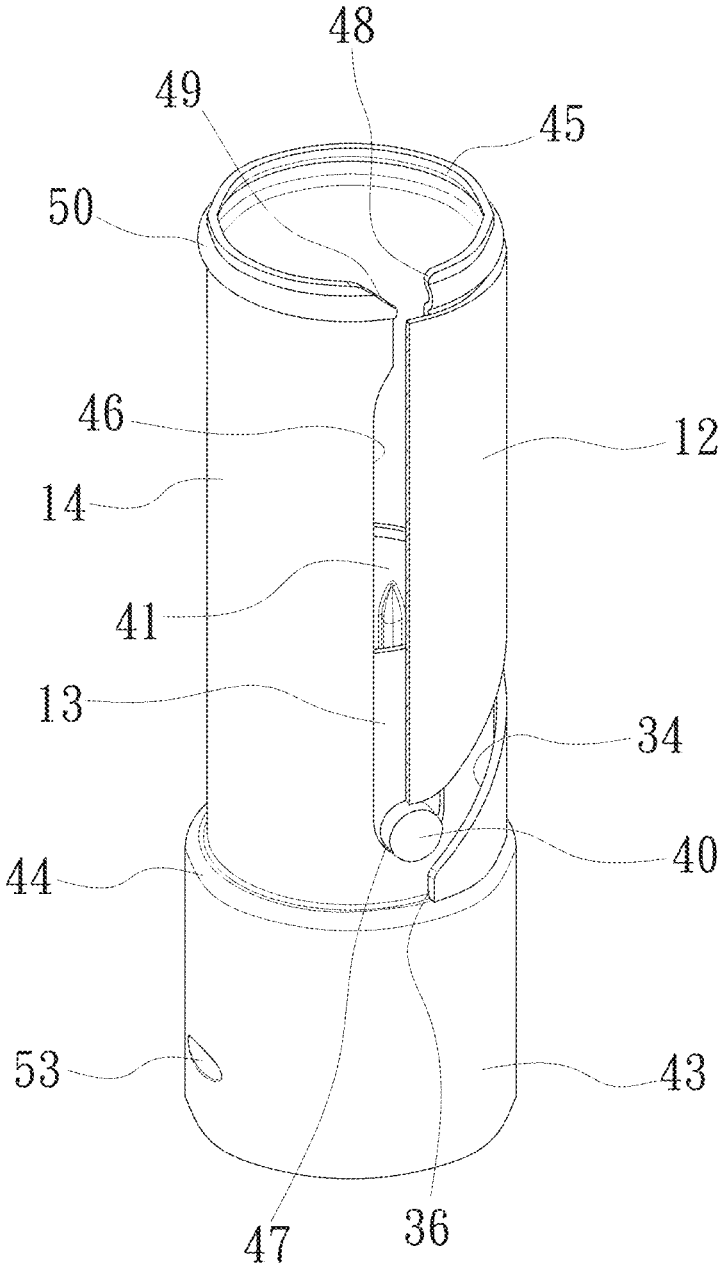
FIG. 4 is a perspective view of the cup and cylinder shown in FIG. 3 and the lining shown in FIG. 2.
Figure 5:
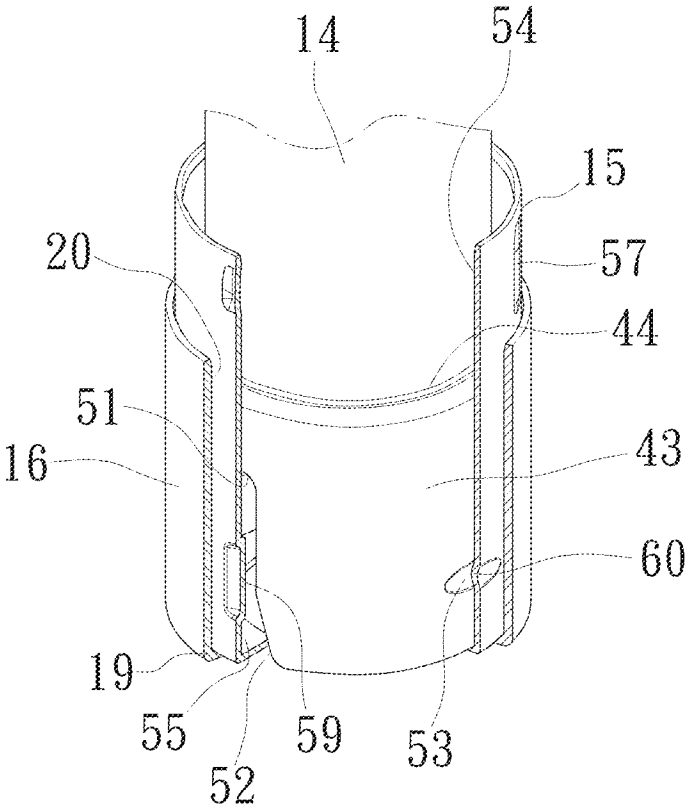
FIG. 5 is a cut-away view of the cylinder shown in FIG. 4, a collar and a grip of the cosmetic container shown in FIG. 1.
Figure 6:
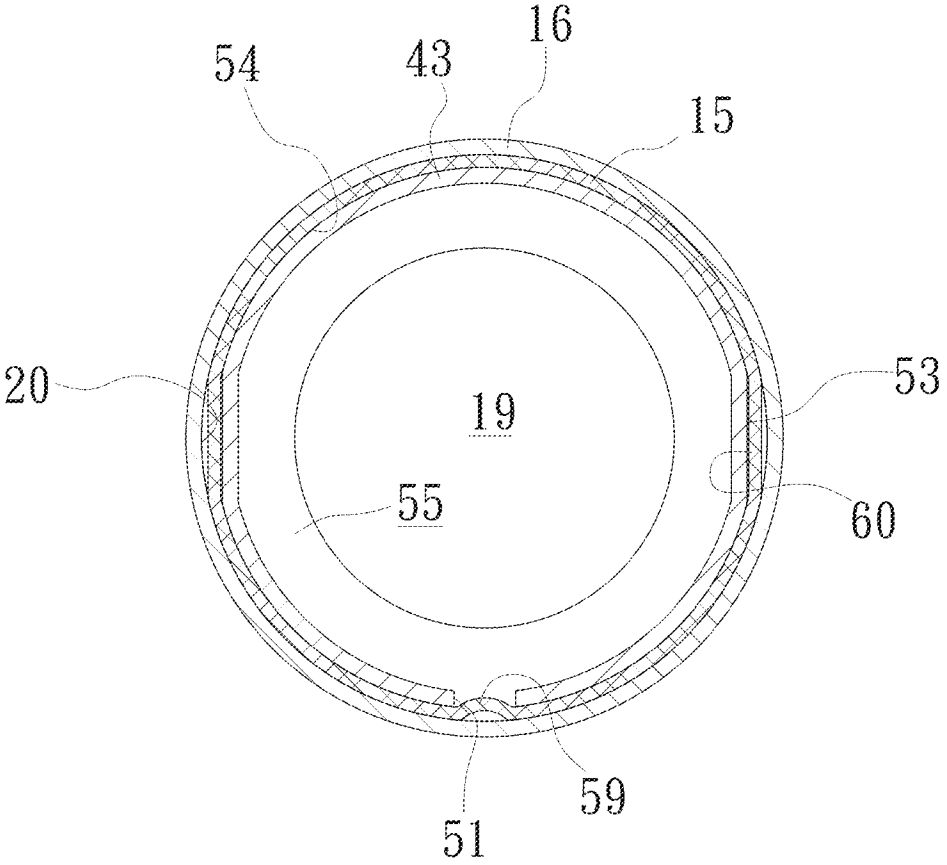
FIG. 6 is a cross-sectional view of the cylinder, collar and grip shown in FIG. 5.
Figure 7:
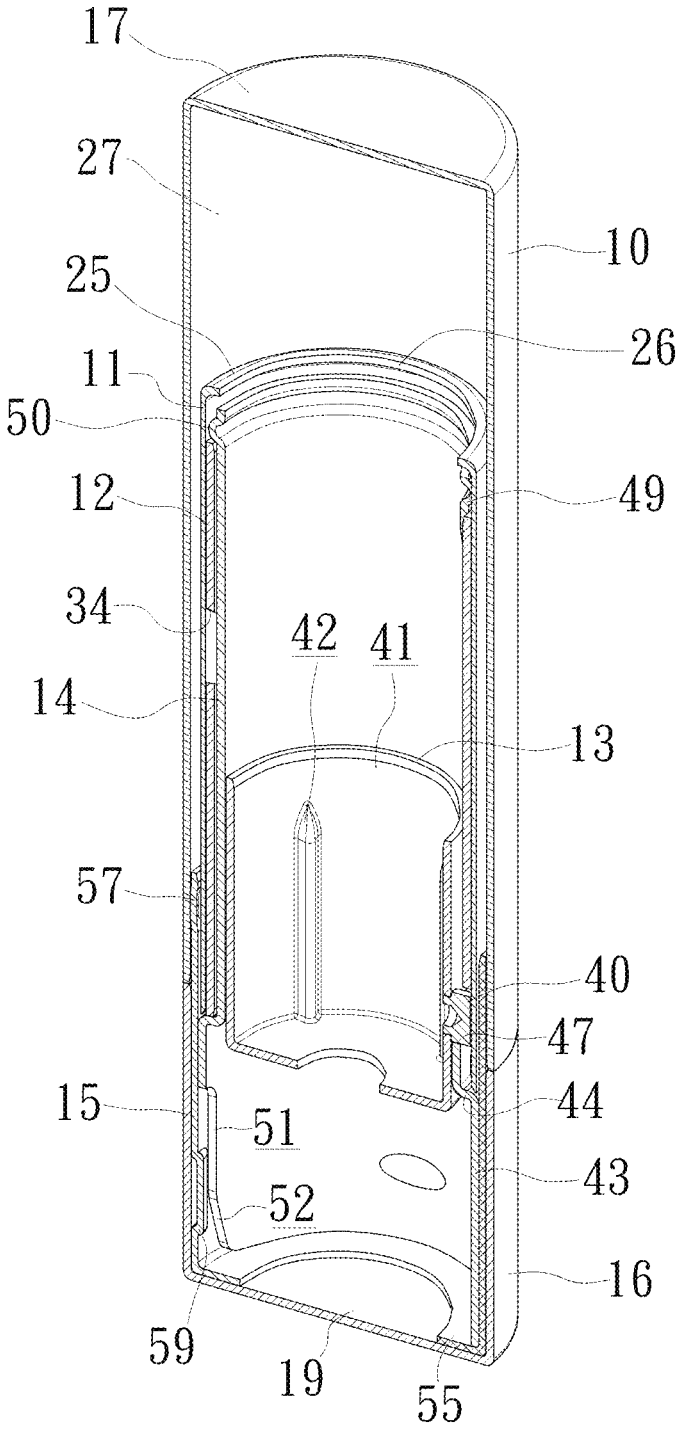
FIG. 7 is a cut-away view of the cosmetic container shown in FIG. 1.
Figure 8:
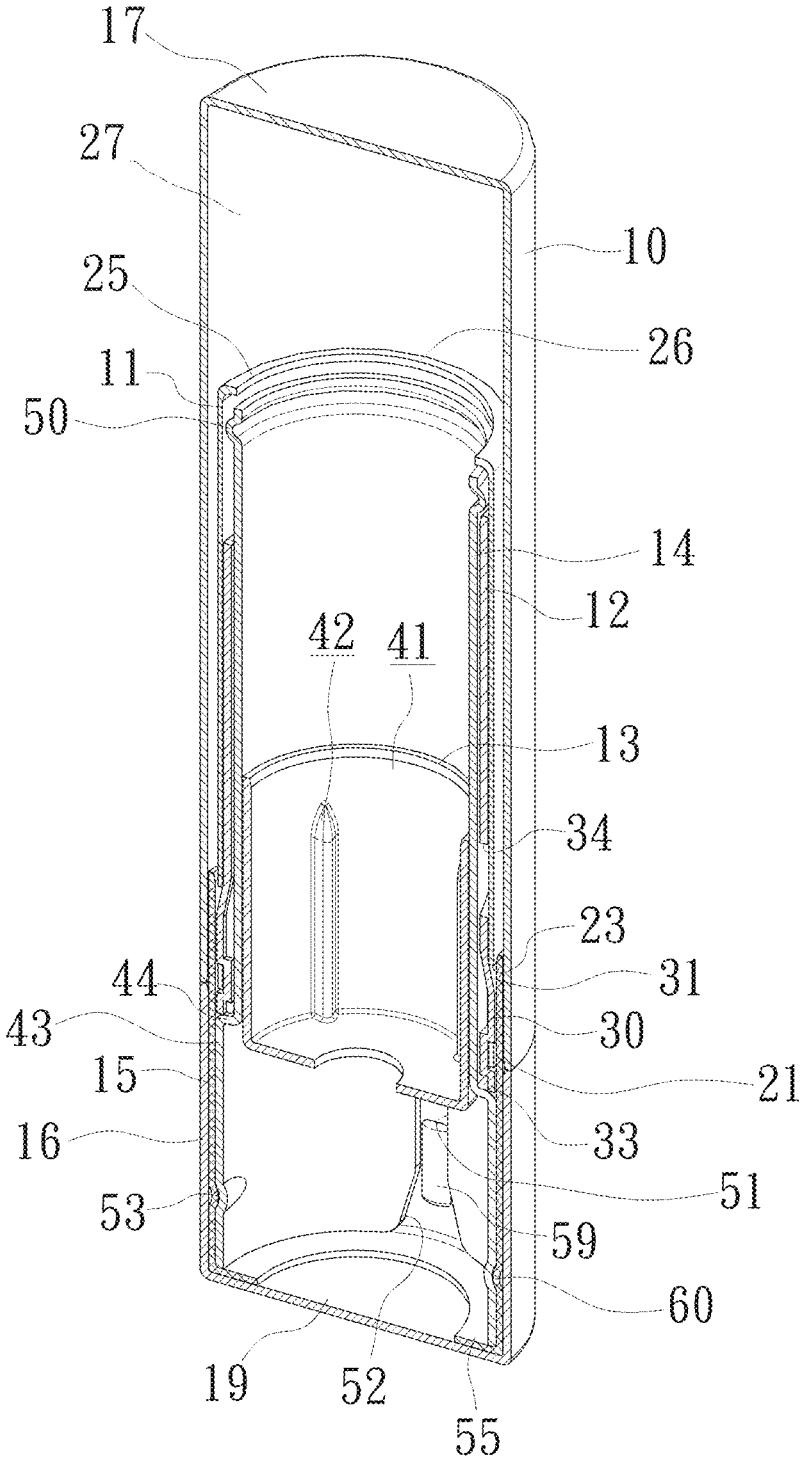
FIG. 8 is a cut-away view of the cosmetic container in another position than shown in FIG. 7.

Referring to FIG. 4, the cylinder 14 is inserted in the sleeve 11 so that they are rotatable relative to each other. A section of the rectilinear slot 46 is in communication with a section of the helical slot 34. An upper edge of the lining 12 is located against the annular flange 50 and a lower edge of the lining 12 is located against the shoulder 44, thereby retaining the lining 12 on the cylinder 14.

A lower section of a lipstick (not shown) is inserted in the cup 13. The cup 13 is inserted in the cylinder 14. The boss 40 is movably inserted in the helical slot 34 and the rectilinear slot 46. Thus, the cup 13 is translatable along but not rotatable relative to the cylinder 14. Moreover, the cup 13 is translated relative to the lining 12 when the cup 13 and the cylinder 14 are rotated relative to the lining 12. Accordingly, an upper section of the lipstick is extended from or into the cylinder 14. The cooperation of the lining 12, the cylinder 14 and the cup 13 with one another enables extension of the lipstick into or from the cylinder 14. The cap 10 is operable to cover the sleeve 11 and hence the lipstick.

The sleeve 11 and the lining 12 are made as separate elements for two reasons. Firstly, the helical slot 34 can easily be made in the lining 12 and that the sleeve 11 can reinforce the lining 12. Secondly, the sleeve 11 and the lining 12 can be detached from each other and recycled separately.

During insertion of the lining 12 into the sleeve 11 via the open end 24 (FIG. 3), the slope 31 allows the guiding block 30 to slide beneath and past the miniature bar 21. Thus, the miniature bar 21 is inserted in the gap 32 between the stopping block 33 and the guiding block 30. The miniature bar 21 is restrained between the stopping block 33 and the guiding block 30, thereby retaining the lining 12 in the sleeve 11.

The stopping block 33 abuts against the miniature bar 21 to prevent the sleeve 11 from downward movement relative to the lining 12. The guiding block 30 abuts against the miniature bar 21 to prevent the sleeve 11 from upward movement relative to the lining 12. The stopping block 33 abuts against two edges of the cutout 22 and the guiding block 30 abuts against two edges of the aperture 23 to prevent the sleeve 11 from rotation relative to the lining 12.

The enlarged section 43 of the cylinder 14 is inserted in the space 54 of the collar 15 as the internal ridge 59 is inserted in the slit 51 via the funnel-like open end 52. The internal protuberances 60 are inserted in the recesses 53, thereby keeping the enlarged section 43 of the cylinder 14 in the collar 15. The external protuberances 57 are located above the enlarged section 43 of the cylinder 14.

An upper section of the collar 15 from which the external protuberances 57 extend receives the lower end of the sleeve 11 and the lower end of the lining 12.

The grip 16 receives the collar 15 except for the upper section so that the external protuberances 57 are located above the grip 16. The protuberances 57 are in contact with an internal face of the cap 10 when the cap 10 covers the sleeve 11, the lining 12, the cylinder 14, the cup 13 and the upper section of the collar 15, thereby keeping the cap 10 on the grip 16.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cosmetic container comprising:

a cup comprising a boss;

a cylinder comprising a first section, a second section, a rectilinear slot in the first section to receive the boss when the cylinder receives the cup, a slit in the second section, and a recess in a second section;

a lining comprising a helical slot for receiving the boss when the lining receives the first section of the cylinder;

a collar comprising an internal ridge movable along the slit when the second section of the cylinder is inserted in the collar and an internal protuberance inserted in the recess.

2. The cosmetic container according to claim 1, wherein the slit comprises a funnel-like open end for easily guiding the internal ridge in the slit.

3. The cosmetic container according to claim 1, comprising a grip and a cap, wherein the collar comprises an external protuberance located above the second section of the cylinder, wherein the grip receives the collar except for the external protuberance, wherein the cap comprises an internal face in contact with the external protuberance when the cap covers the sleeve, the lining, the cylinder, the cup and a section of the collar.

* * * * *